United States Patent [19]

Richardson

[11] 4,410,177

[45] Oct. 18, 1983

[54] BOWLING PIN ORIENTATION DEVICE FOR ORIENTING FALLING BOWLING PINS IN A BOWLING PIN CONVEYOR SYSTEM

[76] Inventor: Cleonard Richardson, 938 NE. 15th, Oklahoma City, Okla. 73105

[21] Appl. No.: 311,526

[22] Filed: Oct. 15, 1981

[51] Int. Cl.[3] ..... A63D 5/09

[52] U.S. Cl. ..... 273/43 D; 193/47; 198/416; 273/43 E

[58] Field of Search ..... 273/43 R, 43 A, 43 D, 273/43 E, 54 R; 193/47, 48; 198/416

[56] References Cited

U.S. PATENT DOCUMENTS

| | | | |
|---|---|---|---|
| 1,421,056 | 6/1922 | Alling et al. | 193/47 |
| 1,539,515 | 5/1925 | Samuelson | 198/416 |
| 2,767,984 | 10/1956 | Zuercher | 273/43 D |
| 3,004,761 | 10/1961 | Congelli et al. | 273/43 E |
| 3,179,410 | 4/1965 | Elliott | 273/43 E |
| 3,526,401 | 9/1970 | Zuercher | 273/43 D |

*Primary Examiner*—Anton O. Oechsle
*Attorney, Agent, or Firm*—Chris H. Morgan

[57] ABSTRACT

A bowling pin orientation device for orienting to a single axial orientation bowling pins of the type having a relatively heavy base portion and a relatively light neck portion. The device includes an arm disposed beneath a horizontal shelf from which bowling pins fall, tipping differently depending on whether base-first or neck-first. The arm extends downwardly and away from the shelf and is disposed so that the neck of a neck-first pin slides along the arm causing the pin to move to a base-down orientation while not receiving the base of a base-first pin so that the base-first pin also moves to a base-down position. The arm preferably includes a projecting finger at its lower end to deflect upwardly the neck of a pin sliding down the arm. The arm can be adjustably positioned across a turnaround pan of the conventional type.

8 Claims, 6 Drawing Figures

BOWLING PIN ORIENTATION DEVICE FOR ORIENTING FALLING BOWLING PINS IN A BOWLING PIN CONVEYOR SYSTEM

BACKGROUND OF THE INVENTION

1. Field of the Invention

This invention relates in general to bowling pin conveyor and setting systems and more particularly to devices for orienting bowling pins within such systems.

2. Description of the Prior Art

In the process of resetting pins on a bowling lane mechanical pin setters and conveyor systems must orient bowling pins so that they can be reloaded for resetting. Generally this requires that at some point in the mechanical conveyor system the pins must be converted from either a neck first axial orientation or a base first axial orientation to a single one of these two orientations.

A common method of orienting bowling pins consists of a rotating belt surface upon which pins of all orientations are received. This belt surface causes the pins to rotate, orienting the pins in one of two axially opposed orientations. With this orientation the pins can fall into slots in a rotating circular pin elevator. The pin elevator carries the pins to a shelf and then allows the pins to fall axially off of the shelf into a turnaround pan having a trough angled downwardly and generally perpendicularly with respect to the pins which are falling from the shelf. Because the pin has a relatively heavy base and a relatively light neck, the pins generally fall into the trough with a base-down orientation. A cross-conveyor then can convey the pins away from the trough in a single axial base-forward or base-first orientation.

A particular problem with this type of orientation device has been that the pins frequently do not fall uniformally into the turnaround pan. Accordingly, their spacing as they enter the cross-conveyor is occasionally too close which can jam the pin setting device to which the pins are conveyed. Furthermore, in some instances the pins are so disoriented when they enter the turnaround pan that they become jammed therein requiring manual removal. Also, frequently pins ride over the edge of the trough and fall onto the floor which also requires manual correction. Finally, as pins are improperly oriented in the pan they can come into contact with belts and sharp metal which are often located just above the turnaround pan. For example, in many orientation devices the belts which rotate the ball elevator and the pin elevator extend just above the turnaround pan and are not covered.

As can be seen, the bowling pin orientation devices of the prior art have been troublesome in that they frequently require manual correction of jams or lost pins. Furthermore, the pins are frequently damaged as they fall from the turnaround pan or encounter moving parts of the bowling pin conveyor.

In attempting to solve the above problems a kick plate has been added to the upper center portion of the trough. This kick plate has a corner portion which encounters the neck portion of a bowling pin which falls from the pin elevator in a neck first orientation. This tends to knock the neck portion upwardly and orient the pin in a base-down orientation in the pan. Pins falling from the pin elevator in a base-forward orientation either do not contact the kick plate or contact a lower portion of it which tends to orient the pin also in a base-down orientation.

Despite the use of the kick plate the above problems with jamming and damage to the pin still occur although less frequently.

SUMMARY OF THE INVENTION

It is accordingly an object of the present invention to provide a bowling pin orientation device which prevents pins from jamming during their orientation.

It is also an object of the present invention to provide a bowling pin orientation device which prevents pins from being damaged during their orientation and more uniformally orients the pins in a single axial orientation.

Another object of the invention is to provide a pin orientation device which can be added to conventional pin orientation devices to improve their ability to properly and efficiently orient the bowling pins.

Yet another object of the present invention is to provide a bowling pin orientation device which is adjustable to provide a proper orientation for different bowling pin conveyor conditions.

Still another object of the present invention is to provide a bowling pin orientation device which is easily mounted to a bowling pin conveyor and which is simple and economical in its parts and operation.

Accordingly, the bowling pin orientation device of the present invention comprises a substantially horizontal shelf and means for horizontally sliding bowling pins axially from the shelf in a selected one of a neck-first and a base-first orientation. A pan is disposed beneath the shelf for receiving the bowling pins sliding off of the shelf. The bowling pin has a downwardly angled trough having an upper end and a lower end and is generally disposed perpendicularly with respect to the axial orientation of bowling pins sliding from the shelf. An arm having a first end, a second end, and a smooth surface therebetween for carrying the neck portion of a bowling pin sliding therealong is attached to the upper end of the trough at its first end. It is attached so that the arm angles downwardly and away from the shelf and across the trough. This angle and position are such that a neck portion of a bowling pin sliding from the shelf in a neck-first orientation will be received on the surface of the arm and slide downwardly therealong allowing this pin to fall into the trough in a base-down orientation. At the same time, bowling pins which fall from the shelf in a base-first orientation will not be received on the surface of the arm and will, therefore, fall into the trough on a base-down orientation.

Preferably, the second end or outer end of the arm has a projecting finger attached thereto and extending therefrom. This finger is positioned so that a bowling pin neck sliding along the surface of the arm will encounter the projecting finger and will be deflected urging a bowling pin into a base-down orientation in the trough. Also preferably the device includes an angular disposition adjustment means for adjusting the angle at which the arm angles downwardly and away from the shelf and across the trough. This allows positioning of the arm for proper and efficient orientation of the bowling pins in accordance with different conveyor system conditions.

As will be apparent, the device of the present invention can easily be prepared through conversion of conventional systems. Particularly, removal of the kick plate in many systems and replacing the kick plate with the above-described arm in a proper position will achieve the device of the present invention.

For a further understanding of the invention and further objects, features and advantages thereof, reference may now be had to the following description taken in conjunction with the accompanying drawings.

BRIEF DESCRIPTION OF THE DRAWINGS

FIG. 6 is a front view of a kick plate utilized in the prior art.

DESCRIPTION OF PREFERRED EMBODIMENTS

Figure 1:
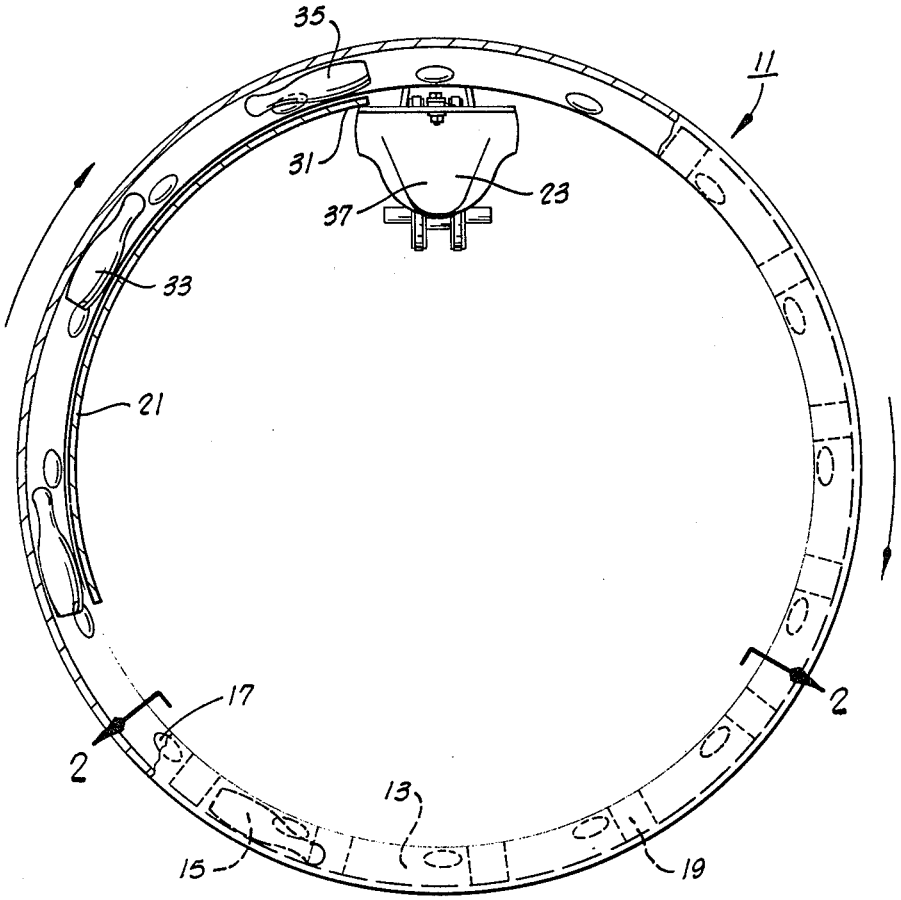
FIG. 1 is a front view of a bowling pin elevator, trough and arm constructed in accordance with the present invention.

Referring to FIG. 1, a portion of a bowling pin conveyor system is shown at 11. The portion shown is located behind an alley such that the pins which fall from the alley will fall adjacent the lower portion of a cylindrical or circular bowling pin elevator 13. A conventional rotating surface (not shown) orients the pins so that they fall into the elevator 13 with either a neck-forward axial orientation or a base-forward axial orientation.

Figure 2:
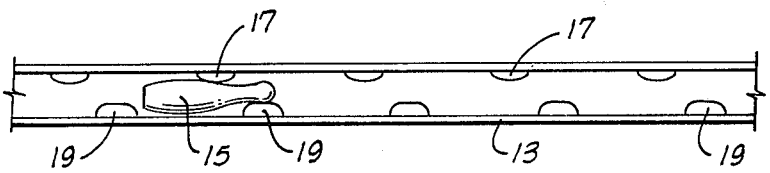
FIG. 2 is a top sectional view of the elevator of FIG. 1 taken along lines shown in FIG. 1.

Referring also to FIG. 2 it can be seen that a pin 15 is held in the slot of the pin elevator in its base-forward orientation by protrusions 17 and 19 located on either side of the interior of elevator 13. These protrusions hold the pin 15 and other pins as the elevator 13 rotates clockwise as shown in FIG. 1.

As the pin elevator 13 rotates the pins held therein achieve first a vertical orientation and then, as the pins near the top of the elevator 13 they re-assume a horizontal orientation. To prevent the pins from falling out of the elevator 13 as they near the top of the elevator 13 a curved plate 21 extends along the interior of elevator 13 from just below a horizontal midpoint of elevator 13 to just prior to a vertical midpoint of elevator 13. The pins in elevator 13 slide along the curved plate 21 within the elevator 13 until they reach the upper edge of plate 21. At this point they fall into a turnaround pan 23.

Figure 3:
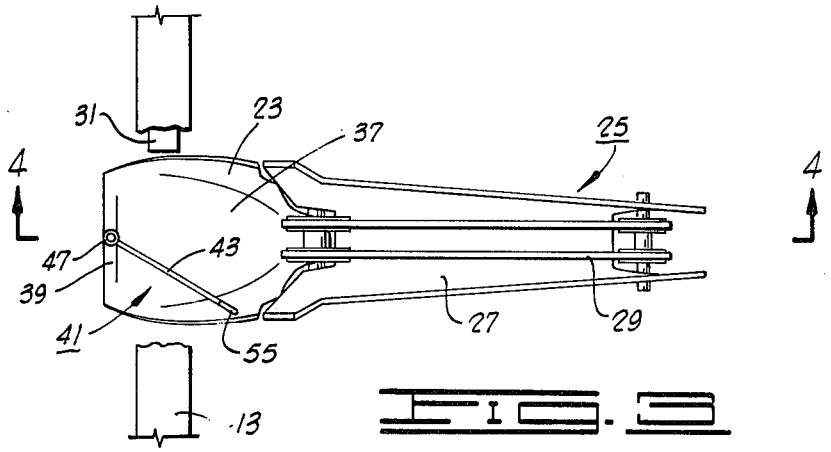
FIG. 3 is a top view of the pan, arm, and cross-conveyor shown in FIG. 1 with a portion of the elevator cut away.
Figure 4:
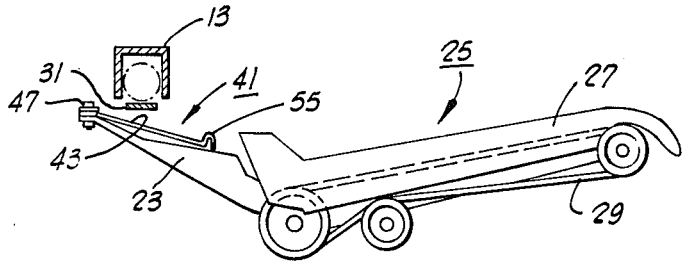
FIG. 4 is a side cross-sectional view of the device of FIG. 3 taken along the lines shown in FIG. 3.
Figure 8:
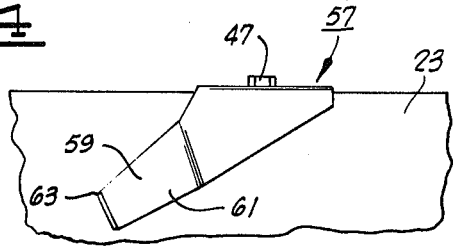
PRIOR ART FIG. 8
Figure 5:
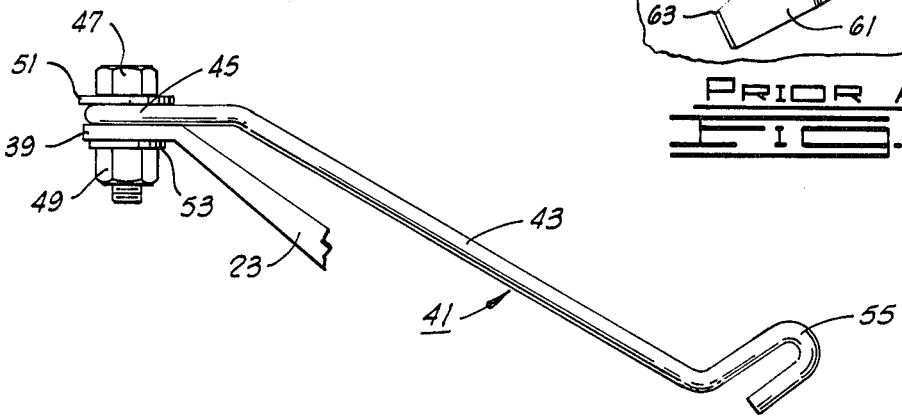
FIG. 5 is a partial, enlarged side view of the pan and arm shown in FIG. 4.

Referring also to FIGS. 3 and 4, the pins which fall into turnaround pan 23 then travel from the bottom of pan 23 along a cross-conveyor 25 to a pin setting device (not shown). The cross-conveyor 25 consists of a trough 27 with a pair of conveyor belts 29 disposed along the bottom thereof. In order for pins to be properly seated in the pin setting machine as they move from the cross-conveyor it is necessary that the pins be transported along the cross-conveyor 25 in a base-forward orientation. This means that the pins must be oriented in a base-down position or base-first in turnaround pan 23 as they are picked up by conveyor belts 29. The purpose of turnaround pan 23 and the device of the present invention is to ensure proper and efficient orientation of the pins in the process of entering cross-conveyor 25 from elevator 23.

As shown in FIGS. 1, 3 and 4 the upper end of curved plate 21 forms a shelf and is disposed generally horizontally. Thus, as the pins conveyed in elevator 23 slide along the curved plate 21 they slide axially from shelf 31 and into pan 23.

Because the bowling pins are relatively heavy at their base end portion and relatively light at their neck end portion, pins which fall from shelf 31 fall differently depending on whether they fall from a base-first position or a neck-first position. Obviously, in a neck-first position the pin extends out further from shelf 31 prior to tipping forward and falling into pan 23. In a base-first position the pin tips faster than in a neck-first position. This difference in the manner of falling into pan 23 is crucial to both the present invention and prior art devices for orienting bowling pins in a single axial orientation.

While it is obvious from the description FIG. 1 shows a bowling pin 33 in a neck-first position and a bowling pin 35 in a base-first position.

As shown in FIGS. 1, 3 and 4 the turnaround pan 23 is disposed beneath shelf 31 for receiving the pins which slide from shelf 31. Pan 23 has a trough portion 37 which receives the pin and conveys it in its proper orientation to conveyor belts 29 on cross-conveyor 25. The trough 37 is disposed at a downward angle so that the pin will be introduced to the conveyor belts 29 by gravity. The trough 37 is disposed perpendicularly with respect to the axial orientation of bowling pins sliding off of shelf 31 to allow proper orientation of the pins, depending upon their base-first or neck-first orientation to occur. As shown in FIGS. 3 and 4 the upper end of trough 37 ends in a flange or lip 39. Attached to the central portion of this lip 39 is a rod 41. It is rod 41 which is the central feature of the present invention.

Rod 41 is preferably a bent piece of bar stock. The central portion of the rod 41 is straight providing a smooth upper surface 43 along which the neck of a bowling pin can slide. A first end 45 of the rod 41 is bent into an eyelet shape which allows the rod to be attached to the flange 39 of turnaround pan 23 by a bolt 47 and a threaded nut 49. Washers 51 and 53 are preferably positioned between the head of nut 47 and bar 41 and between nut 49 and flange 39, respectively.

The second end 55 of rod 41 opposite the first end 45 is bent in a U shape. This U shape extends radially upwardly at an angle from the central portion of rod 41.

As shown in FIG. 3 rod 41 extends downwardly and away from shelf 31 and, hence, downwardly and away from a bowling pin falling from shelf 31. This orientation of rod 41 is very important to the concept of the present invention. Rod 41 slants downwardly to allow the neck of a pin carried thereon to be detained in its falling which allows the base portion of the pin to fall into the trough 37 and thereby orient the pin in a base-down position. The rod 41 extends away from shelf 31 to ensure that only the neck portion is carried on the rod as the pin moves outwardly from shelf 31. Likewise, this urges the pin to a base-down position in trough 37.

The angle at which the rod extends downwardly and away from shelf 31 and falling bowling pins is also important in that the rod 41 must not receive and carry the base portion of a bowling pin which slides from shelf 31 in a base-first or base-forward position. Since the base portion of a pin in a base-first position tilts downwardly more rapidly than the neck portion of a pin in a neck-first position, the rod 41 can be positioned so that only the neck portion of falling bowling pins will encounter the upper surface 43 of rod 41. If the base portion encounters the side of rod 41 it is deflected downwardly.

As shown in FIG. 3, rod 41 extends diagonally across trough 37 from the center of its upper end to the side of its lower end. Through this positioning the rod 41 assists the operation of the trough 37 in orienting the pins to a base down orientation but does not obstruct the trough in any way which will cause jamming of pins in the trough. Containment of bowling pins in the trough and preventing pins from falling from the trough is one of the desired features of the present invention. This is achieved without placing walls about the trough which would obstruct maintenance and possibly damage bowling pins encountering such walls.

As a bowling pin neck slides down the upper surface 43 of rod 41 it will finally encounter the U shaped finger 55 at the lower end of rod 41. This projection from rod 41 causes a pin sliding down the upper surface 43 of rod 41 to be deflected upwardly and further urges the pin to fall into a base-down orientation in trough 37.

As shown in FIG. 6, the prior art utilized a kick plate 57 in attempting to solve the various jamming and other operational problems with conventional pin orientation devices. As used in the prior art, the kick plate 57 would be attached to the flange 39 at the upper end of turnaround pan 23. The upper portion of kick plate 57 conforms with the flange 39 of turnaround pan 23 as well as the interior of the upper end of trough 37. Extending outwardly a short distance into a central area of trough 37 is a trapezoidal flange 59. This flange 59 is tilted so that its face 61 will be encountered by the base portion of a pin moving into trough 37 in a base-first orientation. It is intended to kick the base portion downwardly so that the pin assumes a base-down position in trough 37. As a pin enters trough 37 from a neck-first orientation the neck of the pin will encounter the outermost corner 63 of flange 59 tending to kick the neck of the pin upwardly. While aiding the operation of the turnaround pan 23 the kick plate 57 has not been entirely effective in ending problems with jamming and the like.

As can be seen, the rod 41 can easily replace kick plate 57 in conventional pin orientation devices. Rod 41 operates in a much different manner than kick plate 61 in that rod 41 carries the neck portion of the pin as the base portion falls into trough 37. It also guards the outer edge of trough 37 to prevent pins from falling over this outer edge. Still further, it provides a deflecting finger at the lower end of rod 41 which aids in the orientation of the pin in a base-down position in trough 37.

Another advantage of the present invention over the kick plate 57 of the prior art is that the horizontal and vertical angular disposition of rod 41 across trough 37 can be adjusted. By loosening nut 49 rod 41 can be pivoted to change the horizontal presentation of rod 41 to a falling bowling pin. By changing the angle of rod 41 adjustment can be made to various bowling pin conveyor conditions such as pin size and weight, elevator speed, and variations in positioning of various elements such as the turnaround pan 23.

Thus, the bowling pin orientation device of the present invention is well adapted to attain the objections and advantages mentioned above as well as those inherent therein. While presently preferred embodiments of the invention have been described for the purpose of this disclosure, numerous changes in the construction and arrangements of parts can be made by those skilled in the art which changes are encompassed within the spirit of this invention as defined by the appended claims.

The foregoing disclosure and the showing made in the drawings are merely illustrative of the principles of this invention and are not to be interpreted in a limiting sense.

What is claimed is:

1. A bowling pin orientation device for orienting to a single axial orientation bowling pins of the type having a relatively heavy base portion and a relatively light neck portion comprising:

a substantially horizontal shelf;

means for horizontally sliding bowling pins axially from said shelf with a selected one of a neck-first orientation and a base-first orientation;

a pan disposed beneath said shelf for receiving bowling pins sliding from said shelf, said pan having a downwardly angled trough having an upper end and a lower end and said trough being disposed generally perpendicularly with respect to axial orientations of bowling pins sliding from said shelf; and an arm having a first end, a second end and a smooth surface therebetween for carrying the neck portion of a bowling pin slidingly therealong, said first end of said arm being connected to said upper end of said trough of said pan and said arm extending downwardly and away from said shelf across said trough such that a neck portion of a bowling pin sliding from said shelf in a neck-first orientation will be received on said surface of said arm and slide downwardly therealong allowing a bowling pin falling from said shelf in a neck-first orientation to fall into said trough in base-down orientation, while the base portion of a bowling pin sliding from said shelf in a base-first orientation will not be received on said surface and will fall into said trough in a base-down orientation.

2. The device of claim 1 which further comprises a projecting finger attached to and extending from said second end of said arm such that a bowling pin neck sliding along said surface of said arm will encounter said projecting finger and will be deflected urging a bowling pin into a base-down orientation in said trough.

3. The device of claim 1 which further comprises angular disposition adjustment means for adjusting the angle at which said arm extends downwardly and away from said shelf across said trough.

4. The device of claim 3 wherein said first end of said arm is pivotally connected to said upper end of said trough and wherein said angular disposition adjustment means comprises means for adjustably securing the pivotal connection.

5. A bowling pin deflector for use with a bowling pin conveyor system for orienting a falling bowling pin of the type having a relatively heavy base portion and a relatively light neck portion, comprising:

an arm having a first end and a second end and a smooth surface therebetween for carrying a sliding bowling pin;

attachment means for attaching said arm to a bowling pin conveyor system such that said surface extends downwardly and away from a falling bowling pin in position for receiving only a neck portion of a falling bowling pin and for carrying a neck portion of a falling bowling pin along said surface urging a bowling pin to a base-down orientation; and a projecting finger attached to said second end of said arm such that a falling bowling pin carried down said surface will be deflected upwardly as it encounters said projecting finger urging a bowling pin to a base-down orientation.

6. The deflector of claim 5 which further comprises angular disposition adjustment means for adjusting the angle at which said surface of said arm extends downwardly and away from a falling bowling pin.

7. The deflector of claim 6 wherein said angular disposition adjustment means comprises a shaft adjustably attached to said first end of said arm and a bowling pin conveyor system such that said arm can pivot horizontally about said shaft.

8. The deflector of claim 7 wherein said shaft comprises a bolt and wherein said first end of said arm has an eyelet though which said bolt extends and wherein said angular adjustment means further comprises a nut for threadedly and adjustably connecting said first end of said arm to a bowling pin conveyor system.

* * * * *